US010247200B2

(12) United States Patent
Xing et al.

(10) Patent No.: US 10,247,200 B2
(45) Date of Patent: Apr. 2, 2019

(54) COOLING OR HEATING FLUID CIRCULATION SYSTEM OF A CANTILEVERED CENTRIFUGAL PUMP

(71) Applicant: Tianyi Xing, Tianjin (CN)

(72) Inventors: Yu Xing, Tianjin (CN); Tianyi Xing, Tianjin (CN)

(73) Assignee: TIANJIN CRDT FLUID CONTROL SYSTEM LTD., Tianjin (CN)

( * ) Notice: Subject to any disclaimer, the term of this patent is extended or adjusted under 35 U.S.C. 154(b) by 88 days.

(21) Appl. No.: 15/519,282

(22) PCT Filed: Aug. 27, 2015

(86) PCT No.: PCT/CN2015/088226

§ 371 (c)(1),
(2) Date: Apr. 14, 2017

(87) PCT Pub. No.: WO2016/058454

PCT Pub. Date: Apr. 21, 2016

(65) Prior Publication Data

US 2017/0241438 A1 Aug. 24, 2017

(30) Foreign Application Priority Data

Oct. 17, 2014 (CN) ..... 2014 1 0448893
Mar. 31, 2015 (CN) ..... 2015 1 0150554

(51) Int. Cl.

| | |
|---|---|
| ***F04D 1/00*** | (2006.01) |
| ***F04D 29/58*** | (2006.01) |
| ***F04D 29/043*** | (2006.01) |
| ***F04D 29/10*** | (2006.01) |
| ***F04D 7/06*** | (2006.01) |
| *F04D 29/12* | (2006.01) |

(52) U.S. Cl.

CPC ..... *F04D 29/588* (2013.01); *F04D 1/00* (2013.01); *F04D 7/06* (2013.01); *F04D 29/043* (2013.01); *F04D 29/10* (2013.01); *F04D 29/128* (2013.01)

(58) Field of Classification Search

CPC . F04D 1/00; F04D 7/06; F04D 29/043; F04D 29/08; F04D 29/10; F04D 29/58;

(Continued)

(56) References Cited

U.S. PATENT DOCUMENTS 2,971,784 A * 2/1961 Tracy ..... F04D 29/128 277/360
3,484,113 A * 12/1969 Moore ..... F04D 29/128 277/366

(Continued)

FOREIGN PATENT DOCUMENTS

CN 201310485 Y 9/2009
CN 201461375 U 5/2010

(Continued)

*Primary Examiner* — Carlos A Rivera
*Assistant Examiner* — Sang K Kim
(74) *Attorney, Agent, or Firm* — George G. Wang; Bei & Ocean

(57) ABSTRACT

A cooling or heating fluid circulation system of a cantilevered centrifugal pump, comprises a pump shaft, one end of which is connected with a vane wheel, a shaft sleeve sleeved on the periphery of the pump shaft, a left sealing gland and a right sealing gland, which are sleeved on the periphery of the shaft sleeve, are connected in sequence from one side of the vane wheel along the axial direction of the shaft sleeve; the gap between the left sealing gland and the said shaft sleeve is arranged with an inside rotating sealing ring fixed with the shaft sleeve and an inside stationary sealing ring fixed with the left sealing gland, an outside rotating sealing ring fixed with the shaft sleeve and an outside stationary sealing ring fixed with the right sealing gland are arranged in the gap between the right sealing gland and the shaft sleeve and away from the left sealing gland; a flow-restricted ring is arranged between the inner peripheral surface of the right sealing gland and the shaft sleeve; and a heat exchange fluid circulation channel, which is formed among the gap (Continued)

between the right sealing gland and the shaft sleeve, the shaft sleeve and the pump shaft, is connected with an external heat exchanger via an external channel. The present invention is capable of directly cooling or heating the rotating parts which are most in need of cooling or heating, thus the temperature of the rotating parts can be kept in a certain range.

10 Claims, 9 Drawing Sheets

(58) Field of Classification Search
CPC ..... F04D 29/588; F04D 29/12; F04D 29/122; F04D 29/124; F04D 29/126; F04D 29/128
See application file for complete search history.

(56) References Cited

U.S. PATENT DOCUMENTS 3,762,724 A * 10/1973 Porter ..... F16J 15/3404 277/353
3,806,135 A * 4/1974 Wiese ..... F04D 29/128 277/408
3,811,687 A * 5/1974 Honold ..... F04D 29/128 277/361
4,884,774 A * 12/1989 Rodi ..... H02G 3/22 248/56
5,553,867 A * 9/1996 Rockwood ..... F04D 29/128 277/348
2016/0177962 A1* 6/2016 Laing ..... F04D 13/0613 417/423.13
2017/0130729 A1* 5/2017 Getto ..... F04D 29/10

FOREIGN PATENT DOCUMENTS

| | | | |
|---|---|---|---|
| CN | 202209285 | U | 5/2012 |
| CN | 102900846 | A | 1/2013 |
| CN | 203308792 | U | 11/2013 |
| CN | 104235073 | A | 12/2014 |
| CN | 104806574 | A | 7/2015 |
| CN | 204511995 | U | 7/2015 |
| JP | 200045991 | A | 2/2000 |
| JP | 2014088956 | A | 5/2014 |
| KR | 97-1836 | B1 | 11/1994 |

* cited by examiner

COOLING OR HEATING FLUID CIRCULATION SYSTEM OF A CANTILEVERED CENTRIFUGAL PUMP

FIELD OF THE INVENTION

The invention relates to a cantilevered centrifugal pump, particularly to a cooling or heating fluid circulation system of a cantilevered centrifugal pump.

BACKGROUND OF THE INVENTION

In the oil refining and chemical industry, high temperature centrifugal pumps play an important role in rotating machines, and their cooling or heating is still the focus of attention in this field.

Most of the methods so far focus on cooling the stationary parts of the centrifugal pump, such as the bearing housing, mechanical sealing gland, etc., which are shown in the Chapter "Cooling Water and Lubrication System" of API610 Appendix B (Standard) and the Chapter "Standard Flushing Solution and Standard Seal Flush Solution 02 in Auxiliary Metal Components" of API682 Appendix D (Standard Appendix); and even the methods for the cooling of the rotating parts are also limited to the cooling of the local surface, as described in the Chapter "Standard Flushing Solution and Standard Seal Flush Solution in Auxiliary Metal Components 51, 61, 65A, 65B, 66A, 66B and 52, 53A, 53B, 53C, 54, 55" of API 682 Appendix D (Standard Appendix). Furthermore, the cooling fluid neither can rotate simultaneously together with the rotating part nor can flow along the axial direction after the cooling fluid is in contact with partial rotating part, and the flow area is small. As shown in FIG. 1 and FIG. 2, the cooling channel is formed on the sealing gland 5 of each side of the cantilevered centrifugal pump, i.e., cooling or heating fluid can only be circulated in the channel located on the sealing gland 5 of each side of the cantilevered centrifugal pump, whereas the pump shaft 7 can not be cooled or heated.

In addition, the methods of cooling the stationary component of the centrifugal pump body in the exemplary embodiment is: introduce low temperature circulating fluid, e.g., water, oil, steam or nitrogen, into the pump chamber, bearing box and the hollow cavity of mechanical sealing gland; the fluid flows through the stationary high-temperature parts and then flows out with removing the heat, and the output fluid becomes a high-temperature fluid, and then the fluid flows through the stationary cooler arranged outside the pump for cooling down the temperature, and then reintroduces the low-temperature fluid into the stationary components of pump for circulation, and thus achieves the purpose of controlling the temperature of the pump. This method is called cooling.

Similarly, when the pump needs to be heated, replace the cooler in the above-mentioned cooling method with heater to achieve a heating method. Heating in this way is called heating.

Until now, there is no such technology as introducing the fluid directly into the hollow cavity of rotating parts of the high-temperature centrifugal pump for continuous rotation to achieve cooling or heating.

Thus, the deficiencies in prior art for cooling or heating the high temperature centrifugal pumps are:

(A) only performing cooling or heating to the surface of the rotating parts (such as: shaft or sleeve) of high temperature centrifugal pump has the deficiencies of:

1. The cooling fluid only contacts partial surface of the rotating parts of the centrifugal pump, i.e., the axial length of fluid contacting the rotating parts is short, so that the overflowing area of cooling fluid is small;
2. The portion of the rotating part cooled or heated by the fluid is not the position where most in need of cooling or heating;
3. The fluid can not be axially displaced when it contacts with the surface of the rotating part of the centrifugal pump, so that the convection effect is poor;
4. Targeted cooling cannot be achieved to the whole rotating parts;
5. Direct contacting the cooling fluid with the pump shaft can not be achieved.

(B) Only performing cooling or heating to the stationary components of pump body, e.g. pump casing, bearing box and mechanical sealing gland, has the deficiencies of:

1. All the stationary components are in contact with the atmosphere, which temperature is not same as the core position. Therefore, the true problem of controlling the temperature of core position is not solved yet;
2. The variation of accurate temperature and transient temperature of the core position cannot be accurately measured and monitored;
3. In prior art, there is always a freshly to be transferred feeding material between the components where are cooled or heated and the core components where really need to be cooled or heated, i.e., the feeding material transfers heat to the rotor with a certain time, and the most of the fluid contacted with the rotating parts of the core components of the high temperature centrifugal pump is the freshly to be transferred feeding material. However, these feeding material are simply too late to get cooled or heated to flow away, and replaced by new fresh feeding material, and these fresh feeding material are of constant temperature subjecting to refining or chemical process, i.e., the core position of the rotating parts are always not directly cooled or heated according to the existing technology, more like a light dusting;
4. The rotating parts of the high temperature centrifugal pump are the parts that need to be cooled most, keeping them in a high temperature state will bring a lot of unfavorable factors, which are not listed herein.
5. Similarly, the rotating parts of the high temperature centrifugal pump are the parts that need to be heated most, leaving them without adequate heating will bring a serious result, especially in the startup time, which are not too much mentioned herein.

SUMMARY OF THE INVENTION

The problem to be solved in the present invention is to provide a cooling or heating fluid circulation system of a cantilevered centrifugal pump capable of directly cooling or heating the rotating parts which are most in need of cooling or heating.

The technical scheme of the invention is as follows: a cooling or heating fluid circulation system of a cantilevered centrifugal pump, comprises a pump shaft, one end of which is connected with a vane wheel, a shaft sleeve sleeved on the periphery of the pump shaft, a left sealing gland and a right sealing gland, which are sleeved on the periphery of the shaft sleeve, are connected in sequence along the axial direction of the shaft sleeve; gaps are formed between the left sealing gland and the said shaft sleeve and between the right sealing gland and the said shaft sleeve respectively, the gap between the left sealing gland and the said shaft sleeve is arranged with an inside rotating sealing ring fixed with the shaft sleeve and an inside stationary sealing ring fixed with the left sealing gland, an outside rotating sealing ring fixed with the shaft sleeve and an outside stationary sealing ring fixed with the right sealing gland are arranged in the gap between the right sealing gland and the shaft sleeve and away from the left sealing gland; a flow-restricted ring is arranged between the inner peripheral surface of the right sealing gland and the shaft sleeve; and a heat exchange fluid circulation channel, which is formed among the gap between the right sealing gland and the shaft sleeve, the shaft sleeve and the pump shaft, is connected with an external heat exchanger via an external channel; the heat exchange fluid therein is capable of rotating simultaneously with the rotating parts of the cantilevered centrifugal pump and flowing along the axial direction of rotating parts.

The heat exchange fluid circulation channel comprises the following channels communicated in sequence: a first channel formed on the right sealing gland, an external end of which is connected with the liquid inlet or liquid outlet of the heat exchanger via the external channel; a second channel is formed in the gap between the right sealing gland and the shaft sleeve, and is arranged within the space of one end of the flow-restricted ring adjacent to the left sealing gland; a third channel which is formed on the shaft sleeve; a fourth channel formed between the peripheral surface of the pump shaft and the inner peripheral surface of shaft sleeve; a fifth channel formed on the shaft sleeve, is arranged within the space formed between the flow-restricted ring on the right sealing gland and one end of the outside rotating sealing ring which is away from the outside stationary sealing ring; a sixth channel formed between the outside rotating sealing ring and the right sealing gland, is arranged with an outside pumping ring; and a seventh channel formed on the right sealing gland, an external end of which is connected with the liquid inlet or liquid outlet of the heat exchanger via the external channel.

Wherein the fourth channel is the channel formed by a plurality of sealing strips arranged between the peripheral surface of the pump shaft and the inner peripheral surface of shaft sleeve, said sealing strips are embedded into the peripheral surface of the pump shaft respectively.

In another exemplary embodiment, the heat exchange fluid circulation channel comprises the following channels communicated in sequence: a first channel formed on the right sealing gland, an external end of which is connected with the liquid inlet or liquid outlet of the heat exchanger via the external channel; a second channel is formed in the space between the right sealing gland and the shaft sleeve, and arranged within the space of one end of the flow-restricted ring adjacent to the left sealing gland; a third channel which is formed on the shaft sleeve; an eighth channel formed inside the pump shaft; a ninth channel formed between the pump shaft and the shaft sleeve; a fifth channel formed on the shaft sleeve, is arranged within the space formed between the flow-restricted ring on the right sealing gland and one end of the outside rotating sealing ring which is away from the outside stationary sealing ring; a sixth channel formed between the outside rotating sealing ring and the right sealing gland, is arranged with an outside pumping ring; and a seventh channel formed on the right sealing gland, an external end of which is connected with the liquid inlet or liquid outlet of the heat exchanger via the external channel.

The eighth channel formed inside the pump shaft comprises: a first longitudinal channel formed along the longitudinal direction of the pump shaft, one end of the first longitudinal channel is communicated with the third channel; an axial channel formed along the axial direction of the pump shaft, one end of which is communicated with the other end of the first longitudinal channel; and a second longitudinal channel formed along the longitudinal direction of the pump shaft, one end of which is communicated with the other end of the axial channel, whereas the other end is communicated with the ninth channel.

In another exemplary embodiment, the cooling or heating fluid circulation system of a cantilevered centrifugal pump, comprises a pump shaft, one end of which is connected with a vane wheel, a shaft sleeve sleeved on the periphery of the pump shaft, a left sealing gland and a right sealing gland, which are sleeved on the periphery of the shaft sleeve, are connected in sequence along the axial direction of the shaft sleeve; gaps are formed between the left sealing gland and the said shaft sleeve and between the right sealing gland and the said shaft sleeve respectively, the gap between the left sealing gland and the said shaft sleeve is arranged with an inside rotating sealing ring fixed with the shaft sleeve and an inside stationary sealing ring fixed with the left sealing gland, an outside rotating sealing ring fixed with the shaft sleeve and an outside stationary sealing ring fixed with the right sealing gland are arranged in the gap between the right sealing gland and the shaft sleeve and away from the left sealing gland; wherein, a flow-restricted rotating sealing ring fixed with the shaft sleeve and a flow-restricted stationary sealing ring fixed with the right sealing gland are arranged in the gap between right sealing gland and the shaft sleeve and adjacent to the left sealing gland; the flow-restricted rotating sealing ring is in contact connection with the flow-restricted stationary sealing ring, and a heat exchange fluid circulation channel, which is formed among the gap between the right sealing gland and the shaft sleeve, the shaft sleeve and the pump shaft, is connected with an external heat exchanger via an external channel; the heat exchange fluid therein is capable of rotating simultaneously with the rotating parts of the cantilevered centrifugal pump and flowing along the axial direction of rotating parts.

In another exemplary embodiment, the heat exchange fluid circulation channel comprises the following channels communicated in sequence: a first channel formed on the right sealing gland, an external end of which is connected with the liquid inlet or liquid outlet of the heat exchanger via the external channel; a second channel is formed in the space between the right sealing gland and the flow-restricted rotating sealing ring; a third channel, formed inside the shaft sleeve, is arranged within the space formed between one side of the flow-restricted rotating sealing ring which is away from the flow-restricted stationary sealing ring and the left sealing gland; a fourth channel formed between the peripheral surface of the pump shaft and the inner peripheral surface of shaft sleeve; a fifth channel, formed inside the shaft sleeve, is arranged within the space formed between the flow-restricted stationary sealing ring on the right sealing gland and one end of the outside rotating sealing ring which is away from the outside stationary sealing ring; a sixth channel formed between the outside rotating sealing ring and the right sealing gland, is arranged with an outside pumping ring; and a seventh channel formed on the right sealing gland, an external end of which is connected with the liquid inlet or liquid outlet of the heat exchanger via the external channel.

Wherein the fourth channel is the channel formed by a plurality of sealing strips arranged between the peripheral surface of the pump shaft and the inner peripheral surface of shaft sleeve, said sealing strips are embedded into the peripheral surface of the pump shaft respectively.

In another exemplary embodiment, the heat exchange fluid circulation channel comprises the following channels communicated in sequence: a first channel formed on the right sealing gland, an external end of which is connected with the liquid inlet or liquid outlet of the heat exchanger via the external channel; a second channel is formed in the space between the right sealing gland and the flow-restricted rotating sealing ring; a third channel, formed inside the shaft sleeve, is arranged within the space formed between one end of the flow-restricted rotating sealing ring which is away from the flow-restricted stationary sealing ring and the left sealing gland; an eighth channel formed inside the pump shaft; a ninth channel formed between the pump shaft and the shaft sleeve; a fifth channel formed inside the shaft sleeve, is arranged within the space formed between the flow-restricted stationary sealing ring on the right sealing gland and one end of the outside rotating sealing ring which is away from the outside stationary sealing ring; a sixth channel formed between the outside rotating sealing ring and the right sealing gland, is arranged with an outside pumping ring; and a seventh channel formed on the right sealing gland, an external end of which is connected with the liquid inlet or liquid outlet of the heat exchanger via the external channel.

The eighth channel formed inside the pump shaft comprises: a first longitudinal channel formed along the longitudinal direction of the pump shaft, one end of the first longitudinal channel is communicated with the third channel; an axial channel formed along the axial direction of the pump shaft, one end of which is communicated with the other end of the first longitudinal channel; and a second longitudinal channel formed along the longitudinal direction of the pump shaft, one end of which is communicated with the other end of the axial channel, whereas the other end is communicated with the ninth channel.

The cooling or heating fluid circulation system of a cantilevered centrifugal pump is capable of directly cooling or heating the rotating parts which are most in need of cooling or heating, i.e., providing cooling or heating to the rotating parts of the high temperature centrifugal pump, and keeping the temperature of the rotating parts within a certain range. The present invention has the advantages of:

1. overcoming the deficiencies of the prior art;

2. achieving controlling the temperature of rotating parts of the centrifugal pump instead of passive controlling;

a. for achieving the purpose of cooling or heating the most needed position along the axial direction of the rotating parts, it is designed to arrange the channel at where most in need of cooling or heating, so that the cooling or heating fluid can pass through there;

b. actively increasing or decreasing the flow of the cooling or heating fluid;

3. by measuring the instant fluid temperature when the fluid flowed from the rotating cavity of the rotating parts of the centrifugal pump, the accurate and instant temperature of the core position of the rotating parts can be controlled. Since we could know the possible problems earlier and more accurately, the pump shall operate safe and sound by taking steps earlier;

4. without too much increase of matter input and do not conflict with the standards API610 and API682, the present invention is capable of parallel use with the solutions 52, 53A, 53B, 53C, 54, and all the equipments and solutions having double-surface mechanical sealing or two throttle mechanism;

5. realizing effective temperature control to the rotating parts where most in need of temperature control;

6. broadening the development space for the high temperature centrifugal pump industry, even for oil refining and chemical industry. Since developing deep processing of oil refining and chemical industry is a general trend, and less chemical residues produce higher operating temperature, it requires a certain way to control the pump temperature for developing the industry.

7. adapting to the rotating rotor of chemical reactors and other equipments with rotor and stator, such as: turbines, compressors, fans, motors, generators, engines, combustion engines, screw pumps, gear pumps, etc.

BRIEF DESCRIPTION OF THE DRAWINGS

FIG. 9 shows the structural diagram of the heat exchange fluid circulation channel inside the pump shaft of the first and second embodiments of the cantilevered centrifugal pump of the present invention, in which:

1 support 2 pump casing

3 medium inlet 4 medium outlet

5 sealing gland 6 bearing seat

7 pump shaft 8 heat exchanger

9 external channel 10 vane wheel

Figure 1:
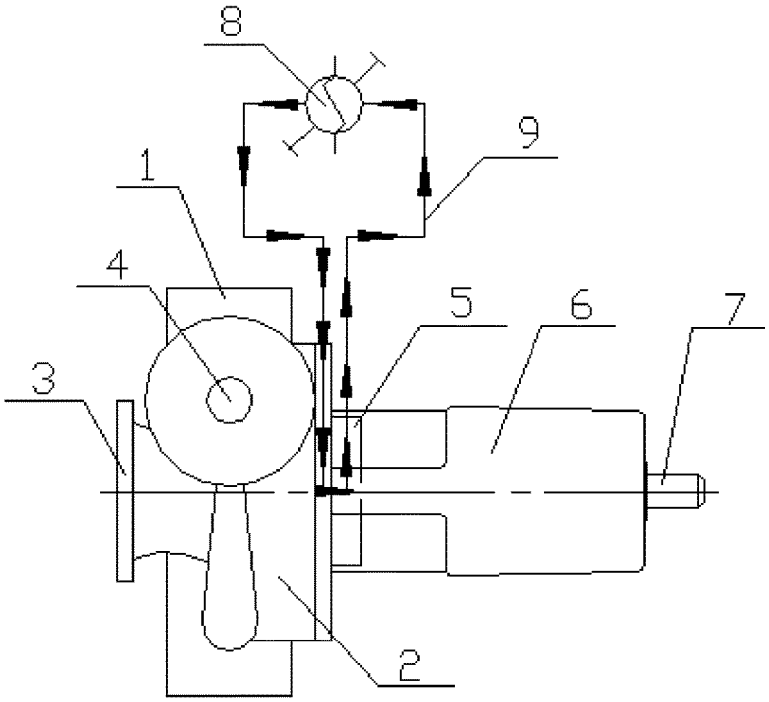
FIG. 1 shows an external structural diagram of a cantilevered centrifugal pump of the prior art.
Figure 2:
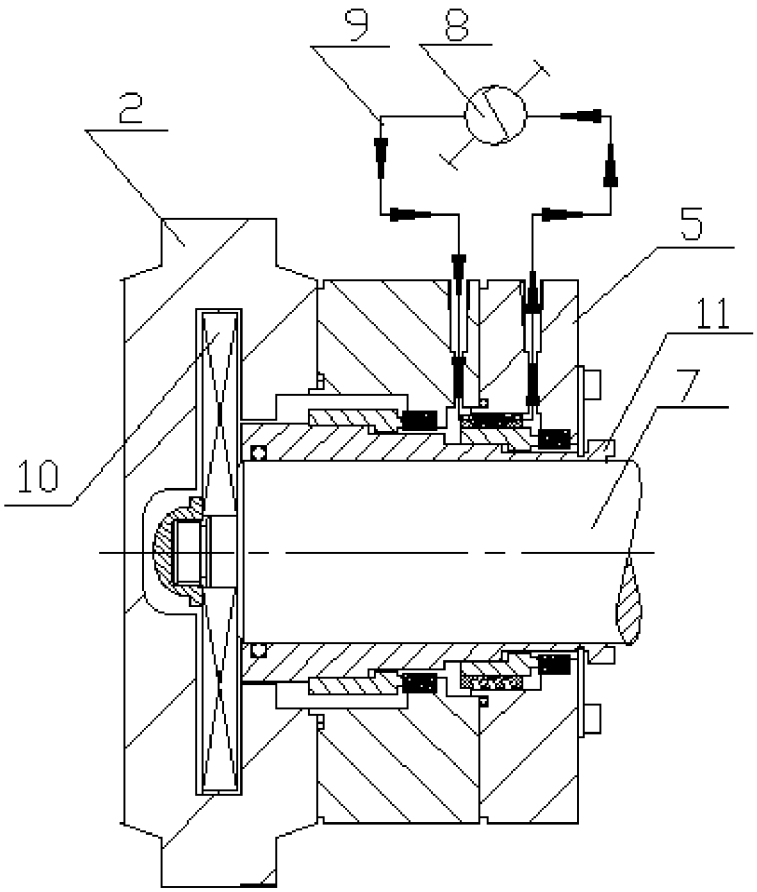
FIG. 2 shows an inner structural diagram of a cantilevered centrifugal pump of the prior art.

11 shaft sleeve 12 inside rotating sealing ring

13 inside stationary sealing ring 14 flow-restricted rotating sealing ring

15 flow-restricted stationary sealing ring 16 flow-restricted ring

17 outside rotating sealing ring 18 outside stationary sealing ring

19 outside pumping ring 20 sealing strips

51 left sealing gland 52 right sealing gland

201 first channel 202 second channel

203 third channel 204 fourth channel

205 fifth channel 206 sixth channel

207 seventh channel 208 eighth channel

209 ninth channel 2081 first longitudinal channel 2082 axial channel 2083 second longitudinal channel

DETAILED DESCRIPTION OF THE EMBODIMENTS

The cooling or heating fluid circulation system of a cantilevered centrifugal pump of the present invention will be described in detail with reference to the embodiments and the accompanying drawings.

The cooling or heating fluid circulation system of a cantilevered centrifugal pump is capable of directly providing cooling or heating fluid to the rotating parts of the high-temperature centrifugal pump which are most in need of cooling or heating. The technical scheme is as follows: by the mechanical sealing or flow restricting mechanism, a circulating fluid with initial temperature flows from external into the rotating part via the stationary component of the pump, the fluid is capable of rotating simultaneously with the rotating part and flowing along the axial direction of the rotating part to the core position where most in need of cooling or heating. After performing sufficient heat exchange, fluid continuously flows out of the rotating part and takes the heat away from the rotating part, and the fluid passes from the inner pump to the external channel for heat exchange outside the pump, and the temperature returns back to the initial temperature, and then the cooled fluid flows into the rotating part of the pump for circulation again, and the heat exchange continuous with the circulation to achieve the purpose of controlling the temperature of rotating parts of the centrifugal pump.

Figure 3:
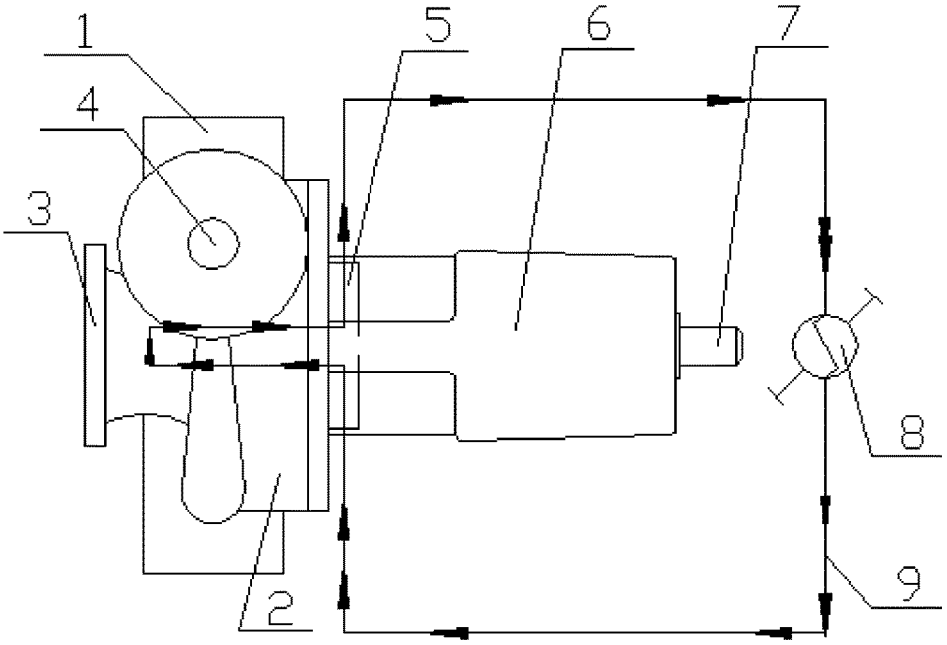
FIG. 3 shows an external structural diagram of the first embodiment of a cantilevered centrifugal pump of the present invention.
Figure 4:
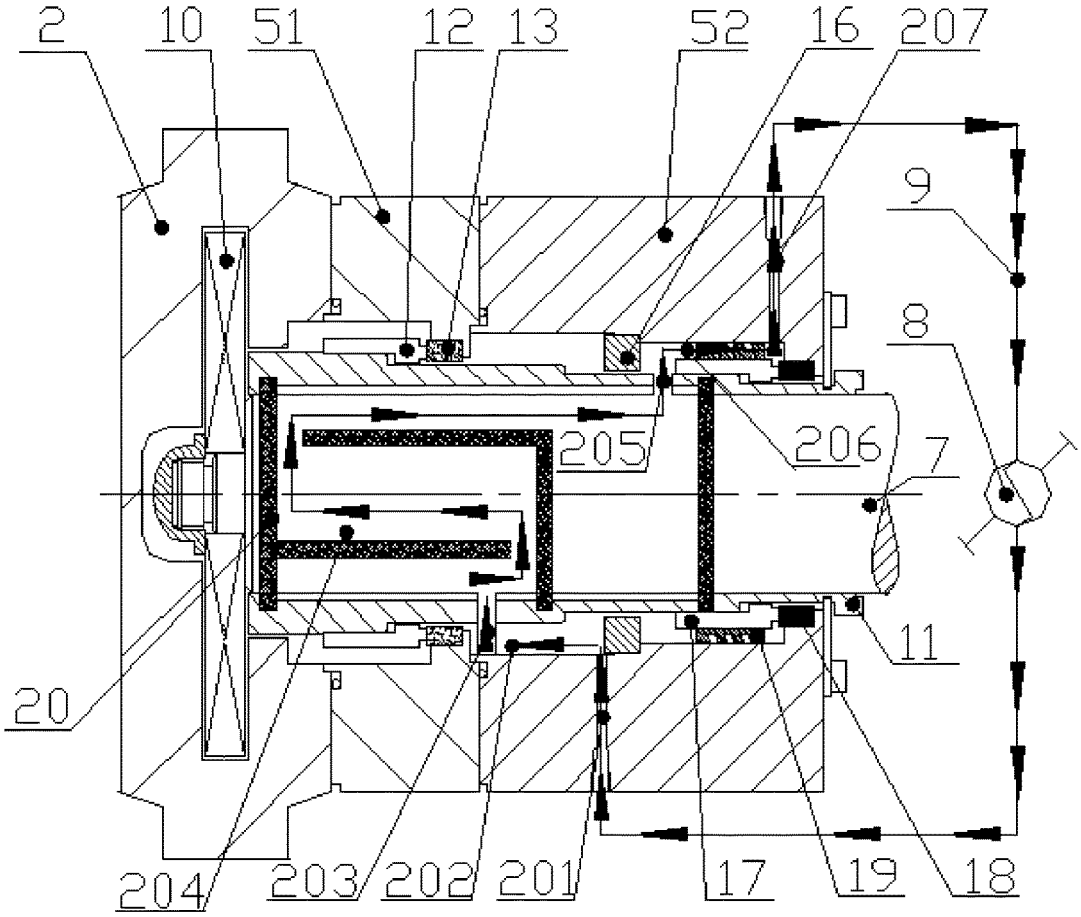
FIG. 4 shows an inner structural diagram of the first embodiment of the cantilevered centrifugal pump of the present invention.
Figure 7:
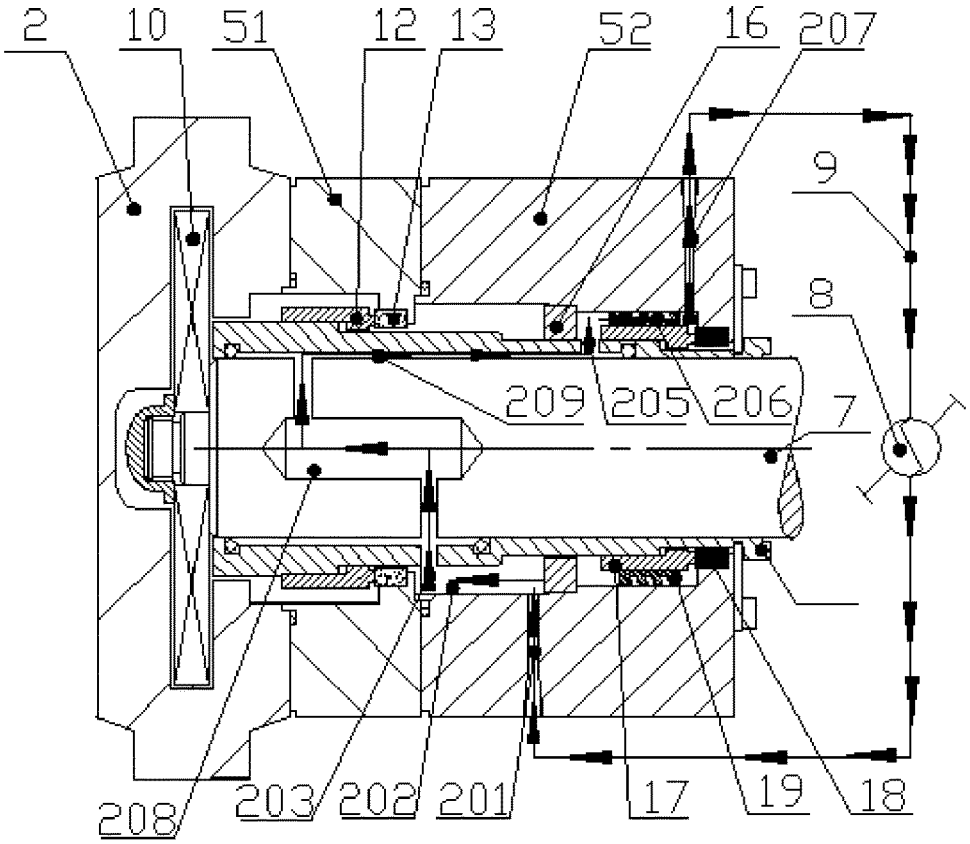
FIG. 7 shows an inner structural diagram of the third embodiment of the cantilevered centrifugal pump of the present invention.

As shown in FIG. 3, FIG. 4 and FIG. 7, the cooling fluid circulation system of the cantilevered centrifugal pump, comprises a pump shaft 7, one end of which is connected with a vane wheel 10, a shaft sleeve 11 sleeved on the periphery of the pump shaft 7, a left sealing gland 51 and a right sealing gland 52, which are sleeved on the periphery of the shaft sleeve 11, are connected in sequence from one end of the vane wheel 10 along the axial direction of the shaft sleeve 11; gaps are formed between the left sealing gland 51 and the said shaft sleeve 11 and between the right sealing gland 52 and the said shaft sleeve 11 respectively, the gap between the left sealing gland 51 and the said shaft sleeve 11 is arranged with an inside rotating sealing ring 12 fixed with the shaft sleeve 11 and an inside stationary sealing ring 13 fixed with the left sealing gland 51, an outside rotating sealing ring 17 fixed with the shaft sleeve 11 and an outside stationary sealing ring 18 fixed with the right sealing gland 52 are arranged in the gap between the right sealing gland 52 and the shaft sleeve 11 and away from the left sealing gland 51; a flow-restricted ring 16 is arranged between the inner peripheral surface of the right sealing gland 52 and the shaft sleeve 11; and a heat exchange fluid circulation channel, which is formed among the gap between the right sealing gland 52 and the shaft sleeve 11, the shaft sleeve 11 and the pump shaft 7, is connected with an external heat exchanger 8 via an external channel 9; the heat exchange fluid therein is capable of rotating simultaneously with the rotating parts of the cantilevered centrifugal pump and flowing along the axial direction of rotating parts.

As shown in FIG. 4, the heat exchange fluid circulation channel comprises the following channels communicated in sequence: a first channel 201 formed on the right sealing gland 52, an external end of which is connected with the liquid inlet or liquid outlet of the heat exchanger 8 via the external channel 9; a second channel 202 is formed in the space between the right sealing gland 52 and the shaft sleeve 11, and is arranged within the space of one end of the flow-restricted ring 16 adjacent to the left sealing gland 51; a third channel 203 which is formed on the shaft sleeve 11; a fourth channel 204 formed between the peripheral surface of the pump shaft 7 and the inner peripheral surface of shaft sleeve 11; a fifth channel 205 formed on the shaft sleeve 11, is arranged within the space formed between the flow-restricted ring 16 on the right sealing gland 52 and one end of the outside rotating sealing ring 17 which is away from the outside stationary sealing ring 18; a sixth channel 206 formed between the outside rotating sealing ring 17 and the right sealing gland 52, is arranged with an outside pumping ring 19; and a seventh channel 207 formed on the right sealing gland 52, an external end of which is connected with the liquid inlet or liquid outlet of the heat exchanger 8 via the external channel 9.

Figure 6:
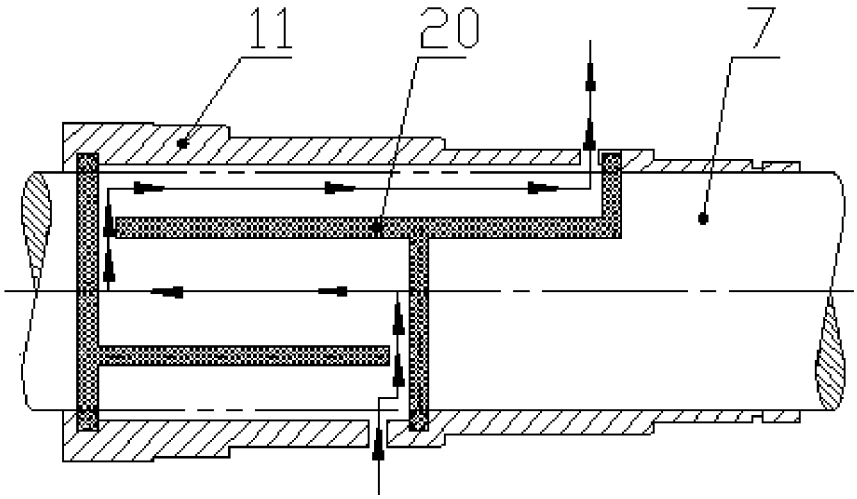
FIG. 6 shows the structural diagram of the heat exchange fluid circulation channel of the periphery of the pump shaft of the first and second embodiments of the cantilevered centrifugal pump of the present invention.

As shown in FIG. 6, the fourth channel 204 is the channel formed by a plurality of sealing strips 20 arranged between the peripheral surface of the pump shaft 7 and the inner peripheral surface of shaft sleeve 11, said sealing strips 20 are embedded into the peripheral surface of the pump shaft 7 respectively.

As shown in FIG. 7, the heat exchange fluid circulation channel comprises the following channels communicated in sequence: a first channel 201 formed on the right sealing gland 52, an external end of which is connected with the liquid inlet or liquid outlet of the heat exchanger 8 via the external channel 9; a second channel 202 is formed in the space between the right sealing gland 52 and the shaft sleeve 11, and arranged within the space of one end of the flow-restricted ring 16 adjacent to the left sealing gland 51; a third channel 203 which is formed on the shaft sleeve 11; an eighth channel 208 formed inside the pump shaft 7; a ninth channel 209 formed between the peripheral surface of the pump shaft 7 and the inner peripheral surface of the shaft sleeve 11; a fifth channel 205 formed on the shaft sleeve 11, is arranged within the space formed between the flow-restricted ring 16 on the right sealing gland 52 and one end of the outside rotating sealing ring 17 which is away from the outside stationary sealing ring 18; a sixth channel 206 formed between the outside rotating sealing ring 17 and the right sealing gland 52, is arranged with an outside pumping ring 19; and a seventh channel 207 formed on the right sealing gland 52, an external end of which is connected with the liquid inlet or liquid outlet of the heat exchanger 8 via the external channel 9.

Figure 9:
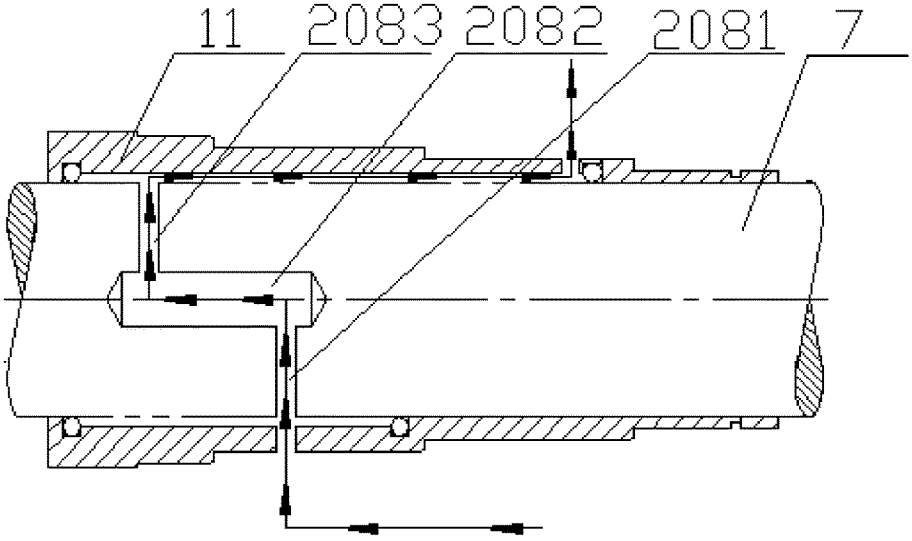

As shown in FIG. 9, the eighth channel 208 formed inside the pump shaft 7 comprises: a first longitudinal channel 2081 formed along the longitudinal direction of the pump shaft 7, one end of the first longitudinal channel 2081 is communicated with the third channel 203; an axial channel 2082 formed along the axial direction of the pump shaft 7, one end of which is communicated with the other end of the first longitudinal channel 2081; and a second longitudinal channel 2083 formed along the longitudinal direction of the pump shaft 7, one end of which is communicated with the other end of the axial channel 2082, whereas the other end is communicated with the ninth channel 209.

Figure 5:
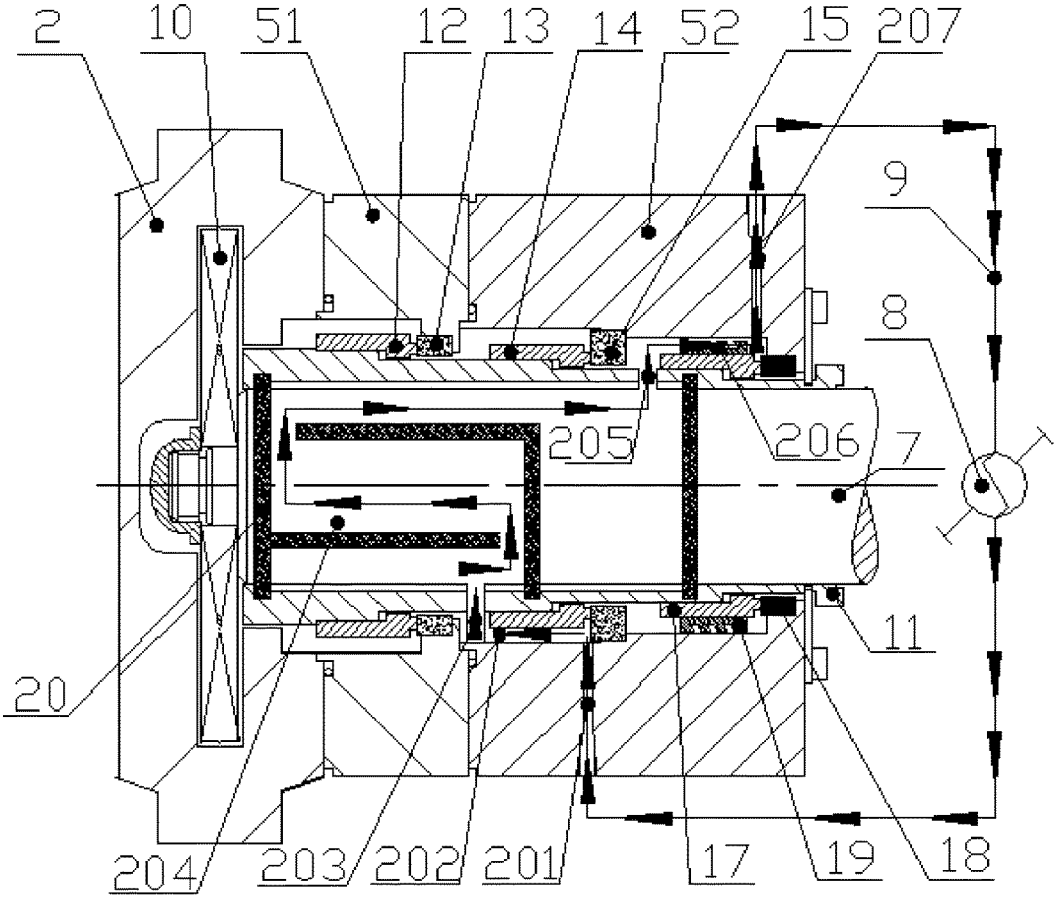
FIG. 5 shows an inner structural diagram of the second embodiment of the cantilevered centrifugal pump of the present invention.
Figure 8:
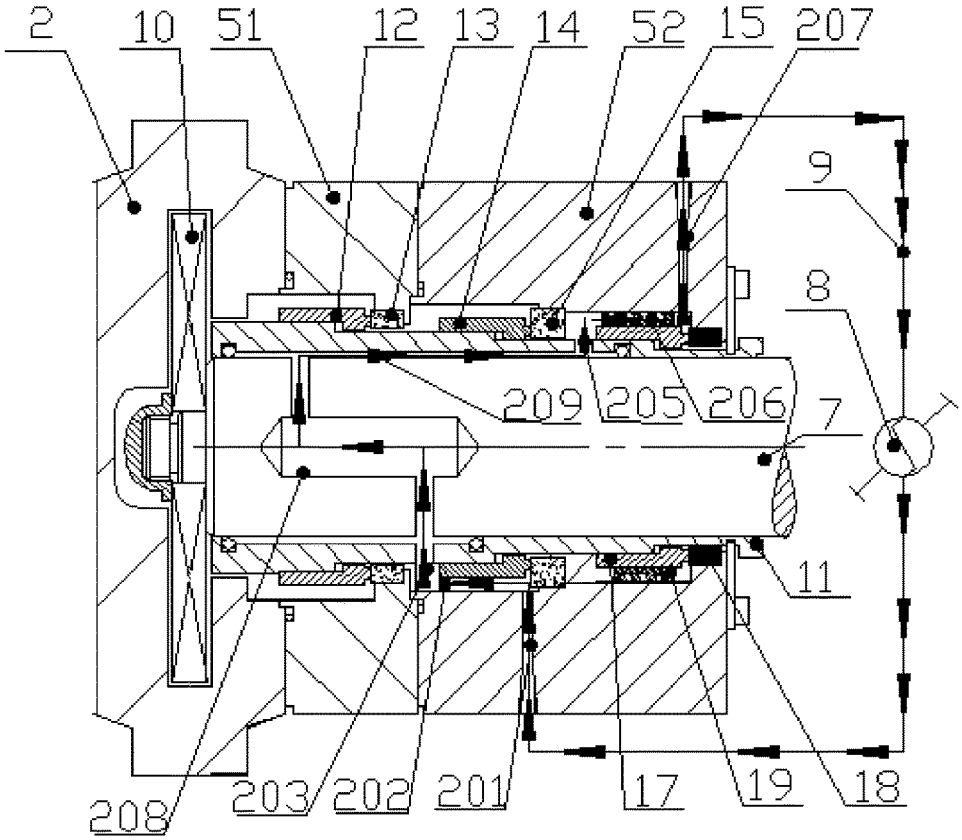
FIG. 8 shows an inner structural diagram of the fourth embodiment of the cantilevered centrifugal pump of the present invention.

As shown in FIG. 3, FIG. 5 and FIG. 8, in another exemplary embodiment, the cooling or heating fluid circulation system of a cantilevered centrifugal pump, comprises a pump shaft 7, one end of which is connected with a vane wheel 10, a shaft sleeve 11 sleeved on the periphery of the pump shaft 7, a left sealing gland 51 and a right sealing gland 52, which are sleeved on the periphery of the shaft sleeve 11, are connected in sequence along the axial direction of the shaft sleeve 11; gaps are formed between the left sealing gland 51 and the said shaft sleeve 11 and between the right sealing gland 52 and the said shaft sleeve 11 respectively, the gap between the left sealing gland 51 and the said shaft sleeve 11 is arranged with an inside rotating sealing ring 12 fixed with the shaft sleeve 11 and an inside stationary sealing ring 13 fixed with the left sealing gland 51, an outside rotating sealing ring 17 fixed with the shaft sleeve 11 and an outside stationary sealing ring 18 fixed with the right sealing gland 52 are arranged in the gap between the right sealing gland 52 and the shaft sleeve 11 and away from the left sealing gland 51; wherein, a flow-restricted rotating sealing ring 14 fixed with the shaft sleeve 11 and a flow-restricted stationary sealing ring 15 fixed with the right sealing gland 52 are arranged in the gap between right sealing gland 52 and the shaft sleeve 11 and adjacent to the left sealing gland 51; the flow-restricted rotating sealing ring 14 is in contact connection with the flow-restricted stationary sealing ring 15, and a heat exchange fluid circulation channel, which is formed among the gap between the right sealing gland 52 and the shaft sleeve 11, the shaft sleeve 11 and the pump shaft 7, is connected with an external heat exchanger 8 via an external channel 9; the heat exchange fluid therein is capable of rotating simultaneously with the rotating parts of the cantilevered centrifugal pump and flowing along the axial direction of rotating parts.

As shown in FIG. 5, in another exemplary embodiment, the heat exchange fluid circulation channel comprises the following channels communicated in sequence: a first channel 201 formed on the right sealing gland 52, an external end of which is connected with the liquid inlet or liquid outlet of the heat exchanger 8 via the external channel 9; a second channel 202 is formed in the space between the right sealing gland 52 and the flow-restricted rotating sealing ring 14; a third channel 203, formed inside the shaft sleeve 11, is arranged within the space formed between one end of the flow-restricted rotating sealing ring 14 which is away from the flow-restricted stationary sealing ring 15 and the left sealing gland 51; a fourth channel 204 formed between the peripheral surface of the pump shaft 7 and the inner peripheral surface of shaft sleeve 11; a fifth channel 205, formed inside the shaft sleeve 11, is arranged within the space formed between the flow-restricted stationary sealing ring 15 on the right sealing gland 52 and one end of the outside rotating sealing ring 17 which is away from the outside stationary sealing ring 18; a sixth channel 206 formed between the outside rotating sealing ring 17 and the right sealing gland 52, is arranged with an outside pumping ring 19; and a seventh channel 207 formed on the right sealing gland 52, an external end of which is connected with the liquid inlet or liquid outlet of the heat exchanger 8 via the external channel 9.

As shown in FIG. 6, wherein the fourth channel 204 is the channel formed by a plurality of sealing strips 20 arranged between the peripheral surface of the pump shaft 7 and the inner peripheral surface of shaft sleeve 11, said sealing strips 20 are embedded into the peripheral surface of the pump shaft 7 respectively.

As shown in FIG. 8, in another exemplary embodiment, the heat exchange fluid circulation channel comprises the following channels communicated in sequence: a first channel 201 formed on the right sealing gland 52, an external end of which is connected with the liquid inlet or liquid outlet of the heat exchanger 8 via the external channel 9; a second channel 202 is formed in the space between the right sealing gland 52 and the flow-restricted rotating sealing ring 14; a third channel 203, formed inside the shaft sleeve 11, is arranged within the space formed between one end of the flow-restricted rotating sealing ring 14 which is away from the flow-restricted stationary sealing ring 15 and the left sealing gland 51; an eighth channel 208 formed inside the pump shaft 7; a ninth channel 209 formed between the peripheral surface of the pump shaft 7 and the inner peripheral surface of the shaft sleeve 11; a fifth channel 205 formed inside the shaft sleeve 11, is arranged within the space formed between the flow-restricted stationary sealing ring 15 on the right sealing gland 52 and one end of the outside rotating sealing ring 17 which is away from the outside stationary sealing ring; a sixth channel 206 formed between the outside rotating sealing ring 17 and the right sealing gland 52, is arranged with an outside pumping ring 19; and a seventh channel 207 formed on the right sealing gland 52, an external end of which is connected with the liquid inlet or liquid outlet of the heat exchanger 8 via the external channel 9.

As shown in FIG. 9, the eighth channel 208 formed inside the pump shaft 7 comprises: a first longitudinal channel 2081 formed along the longitudinal direction of the pump shaft 7, one end of the first longitudinal channel 2081 is communicated with the third channel 203; an axial channel 2082 formed along the axial direction of the pump shaft 7, one end of which is communicated with the other end of the first longitudinal channel 2081; and a second longitudinal channel 2083 formed along the longitudinal direction of the pump shaft 7, one end of which is communicated with the other end of the axial channel 2082, whereas the other end is communicated with the ninth channel 209.

The first embodiment (as shown in FIG. 4) working process of the cooling or heating fluid circulation system of a cantilevered centrifugal pump of the present invention is: the fluid for heat exchanging inside the cantilevered centrifugal pump passes through the heat exchanger 8 via the external channel 9, and passes in sequence of the following communicated channels: the first channel 201 formed on the right sealing gland 52, an external end of which is connected with the liquid inlet or liquid outlet of the heat exchanger 8 via the external channel 9; the second channel 202 formed in the space between the right sealing gland 52 and the shaft sleeve 11, and is arranged within the space of one end of the flow-restricted ring 16 adjacent to the left sealing gland 51; the third channel 203 which is formed on the shaft sleeve 11; the fourth channel 204 formed between the peripheral surface of the pump shaft 7 and the inner peripheral surface of shaft sleeve 11; the fifth channel 205 formed on the shaft sleeve 11, is arranged within the space formed between the flow-restricted ring 16 on the right sealing gland 52 and one end of the outside rotating sealing ring 17 which is away from the outside stationary sealing ring 18; the sixth channel 206 formed between the outside rotating sealing ring 17 and the right sealing gland 52, is arranged with an outside pumping ring 19; and the seventh channel 207 formed on the right sealing gland 52, an external end of which is connected with the liquid inlet or liquid outlet of the heat exchanger 8 via the external channel 9. The fluid performs heat exchange with the rotating part inside the cantilevered centrifugal pump, in particularly performs heat exchange with the pump shaft 7, and the heat exchanged fluid flows out of the seventh channel 207 inside the right sealing gland 52 and flows through the heat exchanger 8 via the external channel 9 for heat exchange, and then the fluid flows into the first channel 201 in the right sealing gland 52 through the external channel 9 again for heat exchange with the rotating part inside the pump. This fluid circulation achieves the heat exchange of the rotating part of the cantilevered centrifugal pump. By arranging the flow-restricted ring 16 between the liquid inlet and liquid outlet of the right sealing gland 52, the fluid flowed into the cantilevered centrifugal pump via the fluid inlet of the heat exchange fluid circulation channel is capable of flowing in the designed heat exchange fluid circulation channel, and flowing out via the fluid outlet of the heat exchange fluid circulation channel after circulation. Thus, the fluid eliminates the absence of heat exchange, i.e., avoid the fluid flowing into the fluid inlet and immediately flowing out of the fluid outlet. Furthermore, using the flow-restricted ring instead of mechanical sealing method has the advantages of saving axial space, simplifying the structure, reducing the costs, shortening the processing cycle, etc.

The working process of the second embodiment of the cooling fluid circulation system of the cantilevered centrifugal pump as shown in FIG. 5 is similar to the first embodiment thereof as shown in FIG. 4. Only one difference in that the flow-restricted rotating sealing ring 14 and the flow-restricted stationary sealing ring 15 are arranged in the gap between right sealing gland 52 and the shaft sleeve 11 in the second embodiment. By arranging a set of throttle mechanical sealing equipment between the liquid inlet and liquid outlet of the right sealing gland 52, the flow-restricted rotating sealing ring 14 and the flow-restricted stationary sealing ring 15 are capable of arranging the fluid flowed into the cantilevered centrifugal pump via the fluid inlet of the heat exchange fluid circulation channel flowing in the designed heat exchange fluid circulation channel, and flowing out via the fluid outlet of the heat exchange fluid circulation channel after circulation. Thus, the fluid eliminates the absence of heat exchange, i.e., avoid the fluid flowing into the fluid inlet and immediately flowing out of the fluid outlet.

The working processes of the third and fourth embodiments of the cooling fluid circulation system of the cantilevered centrifugal pump as shown in FIG. 7 and FIG. 8 are similar to the first and second embodiments thereof. Only one difference in that the fluid for heat exchange flows inside the pump shaft 7 and performs heat exchange in the pump shaft 7 in the third and fourth embodiments. Whereas the fluid for heat exchange flows on the surface of the pump shaft 7 and performs heat exchange in the pump shaft 7 in the first and second embodiments.

In the whole circulation, restricted by oil refining and chemical process, the temperature of fluid feeding material transmitted by the centrifugal pump is constant, i.e., the feeding material transmits the heat to the rotating part requiring a certain time, the rotating part of the centrifugal pump of the present invention performs a new heat exchange with the cooling liquid flowing through the centrifugal pump when the temperature of the rotating part has not yet changed. Therefore, the temperature of the rotating part can always be controlled within a desired range.

What is claimed is:

1. A cooling or heating fluid circulation system of a cantilevered centrifugal pump, comprising a pump shaft (7), wherein one end of the pump shaft is connected with a vane wheel (10), a shaft sleeve (11) sleeved on the periphery of the pump shaft (7), a left sealing gland (51) and a right sealing gland (52), which are sleeved on the periphery of the shaft sleeve (11), wherein the left sealing gland and the right sealing gland are connected in sequence from one end of the vane wheel (10) along the axial direction of the shaft sleeve (11); gaps formed between the left sealing gland (51) and the said shaft sleeve (11) and between the right sealing gland (52) and the said shaft sleeve (11) respectively, where the gap between the left sealing gland (51) and the shaft sleeve (11) houses an inside rotating sealing ring (12) fixed with the shaft sleeve (11) and an inside stationary sealing ring (13) fixed with the left sealing gland (51), an outside rotating sealing ring (17) fixed with the shaft sleeve (11) and an outside stationary sealing ring (18) fixed with the right sealing gland (52) disposed in the gap between the right sealing gland (52) and the shaft sleeve (11) and away from the left sealing gland (51); wherein, a flow-restricted ring (16) is disposed between the inner peripheral surface of the right sealing gland (52) and the shaft sleeve (11); wherein a heat exchange fluid circulation channel, which is formed in at least one of the gap between the right sealing gland (52) and the shaft sleeve (11), the shaft sleeve (11) and the pump shaft (7), is connected with an external heat exchanger (8) via an external channel (9); and wherein the heat exchange fluid therein is capable of rotating simultaneously with rotating parts of the cantilevered centrifugal pump and flowing along the axial direction of rotating parts.

2. The cooling or heating fluid circulation system of the cantilevered centrifugal pump according to claim 1, wherein the heat exchange fluid circulation channel comprises the following channels communicated in sequence: a first channel (201) formed on the right sealing gland (52), wherein an external end of the first channel is connected with a liquid inlet or liquid outlet of the heat exchanger (8) via the external channel (9); a second channel (202) formed in the space between the right sealing gland (52) and the shaft sleeve (11), wherein the second channel is arranged within the space of one end of the flow-restricted ring (16) adjacent to the left sealing gland (51); a third channel (203) formed on the shaft sleeve (11); a fourth channel (204) formed between the peripheral surface of the pump shaft (7) and the inner peripheral surface of shaft sleeve (11); a fifth channel (205) formed on the shaft sleeve (11), wherein the fifth channel is disposed within the space formed between the flow-restricted ring (16) on the right sealing gland (52) and one end of the outside rotating sealing ring (17) which is away from the outside stationary sealing ring (18); a sixth channel (206) formed between the outside rotating sealing ring (17) and the right sealing gland (52), is disposed on an outside pumping ring (19); and a seventh channel (207) formed on the right sealing gland (52), wherein an external end of the seventh channel is connected with a liquid inlet or liquid outlet of the heat exchanger (8) via the external channel (9).

3. The cooling or heating fluid circulation system of the cantilevered centrifugal pump according to claim 2, wherein the fourth channel (204) is a channel formed by a plurality of sealing strips (20) disposed between the peripheral surface of the pump shaft (7) and the inner peripheral surface of shaft sleeve (11), wherein said sealing strips (20) are embedded into the peripheral surface of the pump shaft (7).

4. The cooling or heating fluid circulation system of the cantilevered centrifugal pump according to claim 1, wherein the heat exchange fluid circulation channel comprises the following channels communicated in sequence: a first channel (201) formed on the right sealing gland (52), an external end of the first channel is connected with a liquid inlet or liquid outlet of the heat exchanger (8) via the external channel (9); a second channel (202) is formed in the space between the right sealing gland (52) and the shaft sleeve (11), and disposed within the space of one end of the flow-restricted ring (16) adjacent to the left sealing gland (51); a third channel (203) which is formed on the shaft sleeve (11); an eighth channel (208) formed inside the pump shaft (7); a ninth channel (209) formed between the pump shaft (7) and the shaft sleeve (11); a fifth channel (205)

formed on the shaft sleeve (11), is disposed within the space formed between the flow-restricted ring (16) on the right sealing gland (52) and one end of the outside rotating sealing ring (17) which is away from the outside stationary sealing ring (18); a sixth channel (206) formed between the outside rotating sealing ring (17) and the right sealing gland (52), is disposed on an outside pumping ring (19); and a seventh channel (207) formed on the right sealing gland (52), an external end of the seventh channel is connected with a liquid inlet or liquid outlet of the heat exchanger (8) via the external channel (9).

5. The cooling or heating fluid circulation system of the cantilevered centrifugal pump according to claim 4, wherein the eighth channel (208) formed inside the pump shaft (7) comprises: a first longitudinal channel (2081) formed along the longitudinal direction of the pump shaft (7), one end of the first longitudinal channel (2081) is communicated with the third channel (203); an axial channel (2082) formed along the axial direction of the pump shaft (7), one end of the axial channel is communicated with another end of the first longitudinal channel (2081); and a second longitudinal channel (2083) formed along the longitudinal direction of the pump shaft (7), one end of the second longitudinal channel is communicated with another end of the axial channel (2082), whereas the another end is communicated with the ninth channel (209).

6. A cooling or heating fluid circulation system of the cantilevered centrifugal pump, comprises a pump shaft (7), one end of the pump shaft is connected with a vane wheel (10), a shaft sleeve (11) sleeved on the periphery of the pump shaft (7), a left sealing gland (51) and a right sealing gland (52), which are sleeved on the periphery of the shaft sleeve (11), are connected in sequence from one end of the vane wheel (10) along the axial direction of the shaft sleeve (11); gaps are formed between the left sealing gland (51) and the said shaft sleeve (11) and between the right sealing gland (52) and the said shaft sleeve (11) respectively, the gap between the left sealing gland (51) and the said shaft sleeve (11) is disposed on an inside rotating sealing ring (12) fixed with the shaft sleeve (11) and an inside stationary sealing ring (13) fixed with the left sealing gland (51), an outside rotating sealing ring (17) fixed with the shaft sleeve (11) and an outside stationary sealing ring (18) fixed with the right sealing gland (52) are disposed in the gap between the right sealing gland (52) and the shaft sleeve (11) and away from the left sealing gland (51); wherein, a flow-restricted rotating sealing ring (14) fixed with the shaft sleeve (11) and a flow-restricted stationary sealing ring (15) fixed with the right sealing gland (52) are disposed in the gap between right sealing gland (52) and the shaft sleeve (11) and adjacent to the left sealing gland (51); the flow-restricted rotating sealing ring (14) is in contact connection with the flow-restricted stationary sealing ring (15), and a heat exchange fluid circulation channel, which is formed in at least one of the gap between the right sealing gland (52) and the shaft sleeve (11), the shaft sleeve (11) and the pump shaft (7), is connected with an external heat exchanger (8) via an external channel (9); the heat exchange fluid therein is capable of rotating simultaneously with the rotating parts of the cantilevered centrifugal pump and flowing along the axial direction of rotating parts.

7. The cooling or heating fluid circulation system of the cantilevered centrifugal pump according to claim 6, wherein the heat exchange fluid circulation channel comprises the following channels communicated in sequence: a first channel (201) formed on the right sealing gland (52), an external end of the first channel is connected with a liquid inlet or liquid outlet of the heat exchanger (8) via the external channel (9); a second channel (202) is formed in the space between the right sealing gland (52) and the flow-restricted rotating sealing ring (14); a third channel (203), formed inside the shaft sleeve (11), is disposed within the space formed between one end of the flow-restricted rotating sealing ring (14) which is away from the flow-restricted stationary sealing ring (15) and the left sealing gland (51); a fourth channel (204) formed between the peripheral surface of the pump shaft (7) and the inner peripheral surface of shaft sleeve (11); a fifth channel (205), formed inside the shaft sleeve (11), is disposed within the space formed between the flow-restricted stationary sealing ring (15) on the right sealing gland (52) and one end of the outside rotating sealing ring (17) which is away from the outside stationary sealing ring (18); a sixth channel (206) formed between the outside rotating sealing ring (17) and the right sealing gland (52), is disposed on an outside pumping ring (19); and a seventh channel (207) formed on the right sealing gland (52), an external end of the seventh channel is connected with a liquid inlet or liquid outlet of the heat exchanger (8) via the external channel (9).

8. The cooling or heating fluid circulation system of the cantilevered centrifugal pump according to claim 7, wherein the fourth channel (204) is the channel formed by a plurality of sealing strips (20) disposed between the peripheral surface of the pump shaft (7) and the inner peripheral surface of shaft sleeve (11), said sealing strips (20) are embedded into the peripheral surface of the pump shaft (7).

9. The cooling or heating fluid circulation system of the cantilevered centrifugal pump according to claim 6, wherein the heat exchange fluid circulation channel comprises the following channels communicated in sequence: a first channel (201) formed on the right sealing gland (52), an external end of the first channel is connected with a liquid inlet or liquid outlet of the heat exchanger (8) via the external channel (9); a second channel (202) is formed in the space between the right sealing gland (52) and the flow-restricted rotating sealing ring (14); a third channel (203), formed inside the shaft sleeve (11), is disposed within the space formed between one end of the flow-restricted rotating sealing ring (14) which is away from the flow-restricted stationary sealing ring (15) and the left sealing gland (51); an eighth channel (208) formed inside the pump shaft (7); a ninth channel (209) formed between the peripheral surface of the pump shaft (7) and the inner peripheral surface of the shaft sleeve (11); a fifth channel (205) formed inside the shaft sleeve (11), is disposed within the space formed between the flow-restricted stationary sealing ring (15) on the right sealing gland (52) and one end of the outside rotating sealing ring (17) which is away from the outside stationary sealing ring (18); a sixth channel (206) formed between the outside rotating sealing ring (17) and the right sealing gland (52), is disposed on an outside pumping ring (19); and a seventh channel (207) formed on the right sealing gland (52), an external end of the seventh channel is connected with a liquid inlet or liquid outlet of the heat exchanger (8) via the external channel (9).

10. The cooling or heating fluid circulation system of the cantilevered centrifugal pump according to claim 9, wherein the eighth channel (208) formed inside the pump shaft (7) comprises: a first longitudinal channel (2081) formed along the longitudinal direction of the pump shaft (7), one end of the first longitudinal channel (2081) is communicated with the third channel (203); an axial channel (2082) formed along the axial direction of the pump shaft (7), one end of the axial channel is communicated with another end of the first longitudinal channel (2081); and a second longitudinal channel (2083) formed along the longitudinal direction of the pump shaft (7), one end of the second longitudinal is communicated with another end of the axial channel (2082), whereas the another end is communicated with the ninth channel (209).

* * * * *